US008096388B2

(12) United States Patent
Nakamura

(10) Patent No.: US 8,096,388 B2
(45) Date of Patent: Jan. 17, 2012

(54) ELEVATOR SYSTEM FOR TRANSMITTING INFORMATION TO PASSENGER

(75) Inventor: Kuniko Nakamura, Tokorozawa (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 686 days.

(21) Appl. No.: 12/282,942

(22) PCT Filed: Mar. 14, 2007

(86) PCT No.: PCT/JP2007/055027
§ 371 (c)(1),
(2), (4) Date: Sep. 15, 2008

(87) PCT Pub. No.: WO2007/119350
PCT Pub. Date: Oct. 25, 2007

(65) Prior Publication Data

US 2009/0095575 A1 Apr. 16, 2009

(30) Foreign Application Priority Data

Mar. 20, 2006 (JP) ..... 2006-077246

(51) Int. Cl.
*B66B 1/34* (2006.01)

(52) U.S. Cl. ..... 187/391; 187/396

(58) Field of Classification Search ..... 187/247, 187/248, 391–396
See application file for complete search history.

(56) References Cited

U.S. PATENT DOCUMENTS

| | | | | |
|---|---|---|---|---|
| 4,749,062 | A * | 6/1988 | Tsuji et al. | 187/396 |
| 4,852,696 | A * | 8/1989 | Fukuda et al. | 187/392 |
| 4,989,694 | A * | 2/1991 | Ueshima et al. | 187/380 |
| 4,995,479 | A * | 2/1991 | Fujiwara et al. | 187/397 |
| 5,844,171 | A * | 12/1998 | Fitzgerald | 174/92 |
| 6,003,637 | A * | 12/1999 | Kim et al. | 187/391 |
| 6,408,988 | B2 * | 6/2002 | Hani et al. | 187/391 |
| 6,828,918 | B2 * | 12/2004 | Bowman et al. | 340/4.1 |
| 6,868,945 | B2 * | 3/2005 | Schuster et al. | 187/380 |
| 6,986,408 | B2 * | 1/2006 | Takeuchi | 187/380 |
| 7,262,753 | B2 * | 8/2007 | Tanghe et al. | 345/82 |
| 7,319,968 | B2 * | 1/2008 | Friedli et al. | 705/305 |
| 7,878,307 | B2 * | 2/2011 | Newville et al. | 187/396 |
| 2003/0089558 | A1 * | 5/2003 | Zepke et al. | 187/413 |
| 2004/0257007 | A1 * | 12/2004 | Lys et al. | 315/294 |

FOREIGN PATENT DOCUMENTS

| | | |
|---|---|---|
| AU | 666237 | 7/1994 |
| JP | 6-234470 A | 8/1994 |
| JP | 11-165960 A | 6/1999 |
| JP | 2001-122543 A | 5/2001 |
| JP | 2001-341951 A | 12/2001 |
| JP | 2006-050528 A | 2/2006 |

* cited by examiner

*Primary Examiner* — Anthony Salata
(74) *Attorney, Agent, or Firm* — Foley & Lardner LLP

(57) ABSTRACT

An elevator system has a data receiving unit that receives service state data transmitted from a control device of an elevator. A pulse modulation unit separates the service state data received by the data receiving unit into first information data and second information data, pulse-modulates the first information data by using the second information data, and creates an LED blinking pattern. An LED drive unit drives a visible light LED placed in a cage of the elevator or on a platform of the elevator in response to the LED blinking pattern created by the pulse modulation unit.

8 Claims, 4 Drawing Sheets

ELEVATOR SYSTEM FOR TRANSMITTING INFORMATION TO PASSENGER

TECHNICAL FIELD

The present invention relates to an elevator system, and particularly relates to an elevator system that transmits special information to passengers by using a display device or illumination device of an elevator.

BACKGROUND ART

In an elevator cage and on elevator platforms, a conventional elevator system places a variety of display devices (for example, a display device displaying a cage position and operation direction of an elevator and a registration state of calls of the platforms concerned by symbols such as "↑, ↓", a display device displaying an operation state of a special operation (referred to as a controlled operation) performed by the elevator in the case of emergency such as an earthquake, a fire and a power failure, a full-loaded state of the cage, and the like, an arrival lamp (also referred to as a lantern) displaying that the elevator is approaching, an inspection lamp indicating that the elevator is under inspection, a halt lamp indicating that the elevator system is out of service, a pet-accommodated operation lamp indicating that a passenger is getting on the elevator together with a pet, and the like).

Moreover, as illumination devices in the cage, there are a power failure lamp driven by a battery at a time of the power failure, and the like, as well as a fluorescent lamp and a light bulb, which are placed on a ceiling of the cage.

Heretofore, as these display devices, there have been many of a type in which an acrylic plate on which display contents are described is illuminated from a back surface thereof by using a filament bulb such as an incandescent bulb and a halogen bulb. Moreover, excluding the fluorescent lamp, it has been frequent that each of the illumination devices uses the filament bulb.

Moreover, in recent years, while systems using light emitting diodes (LEDs) have been being increased, systems which offer various kinds of audio information and video information in the cage and platforms of the elevator have been put into practical use in accordance with the recent advent of the information-oriented society.

For example, in the cage, it is announced which floor the cage is going to stop at immediately before the cage arrives at the floor concerned, it is announced that a door is going to open/close, saying "Door is going to close" and the like, and an operation direction is announced, saying "Elevator is going upward" and the like. Besides such operation states, BGM is sometimes piped into the cage. Furthermore, as an example of offering the video information, a system that displays an image of an in-cage security camera on monitors on the platforms and allows passengers waiting on the platforms to confirm whether or not there is a suspicious person in the cage has been put into practical use. Moreover, such display devices have also been put into practical use, that can allow an administrator of a building to display a textual message on the display device concerned in place of a bulletin board, that can display date information and an operation state of the elevator thereon, and that can display video information of a DVD thereon.

[Patent Document 1] Japanese Patent Laid-Open Publication No. H11-165960

[Patent Document 1] Japanese Patent Laid-Open Publication No. H06-234470

DISCLOSURE OF THE INVENTION

As described above, in the elevator system in recent years, a demand that the various kinds of audio information and video information be offered to an inside of the cage and to the platforms has been increased. However, in order to respond to such a demand, information instruments such as an announcement devices and monitor devices must be placed in the cage and on the platforms, and there has been a problem that cost for the instruments, cost for attaching/wiring work thereof, and the like are required.

Moreover, in the elevator in recent years, elimination of an extra space has progressed, and it has been sometimes difficult to attach the instruments to the elevator depending on sizes thereof.

Furthermore, recently, in order to solve these problems, a system has been proposed, in which short-range communication instruments are placed in the cage and on the platforms, and each of the passengers has a portable terminal having a function of short-range wireless communication corresponding to the short-range communication instruments, whereby information is offered to the mobile terminal concerned. For the short-range wireless communication instruments in this case, infrared communication, wireless communication by radio waves, which is used in a cellular phone, a wireless LAN and the like, and the like have been utilized.

However, in such wireless communication means as described above, there has been a problem that it is necessary to place dedicated communication instrument and transmission line in the elevator.

Besides the above, for example in the infrared communication, there has been a problem that a communication distance cannot be elongated since an intense infrared ray cannot be outputted because of a necessity to protect passengers' eyes. Moreover, in the wireless communication by radio waves, there have been such problems that a transmission power thereof cannot be increased because of an influence of electromagnetic waves on human bodies, and that a wideband radio frequency cannot be used because of restrictions from the radio law.

It is an object of the present invention to provide an elevator system capable of enhancing convenience for the passengers to a great extent by notifying the passengers of special guide information such as a registration state of a call of a wheelchair platform, the full-loaded state, a controlled operation state, a halt state, an under-inspection state, and a cage arrival forecast without placing the dedicated communication instrument such as the wireless LAN instrument, or the like, or without adversely affecting the human bodies.

In order to achieve the above-described object, a first aspect of the present invention is an elevator system, including: a data receiving unit that receives service state data transmitted from a control device of an elevator; a pulse modulation unit that separates the service state data received by the data receiving unit into first information and second information, pulse-modulates the first information by using the second information, and creates an LED blinking pattern; and an LED drive unit that drives a visible light LED placed in a cage of the elevator or on a platform of the elevator in response to the LED blinking pattern created by the pulse modulation unit.

In accordance with the elevator system of the first aspect of the present invention, the convenience for the passengers can be enhanced to a great extent.

BEST MODE FOR CARRYING OUT THE INVENTION

Next, a description will be made of embodiments of the present invention. Note that, in the following description, from a viewpoint of avoiding a duplicate description, a description will be made of examples where the present invention is applied to a display device; however, in a similar way, the present invention can also be applied to an illumination device using a visible light LED.

FIRST EMBODIMENT

Figure 1:
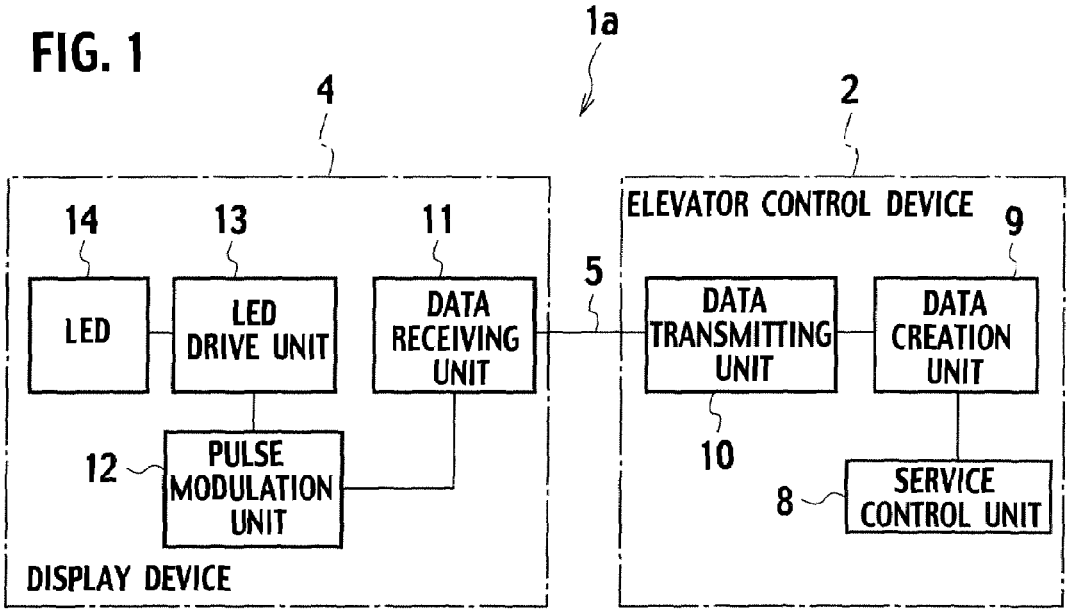
FIG. 1 is a block diagram showing a first embodiment of an elevator system according to the present invention.

FIG. 1 is a block diagram showing a first embodiment of an elevator system according to the present invention.

Figure 2:
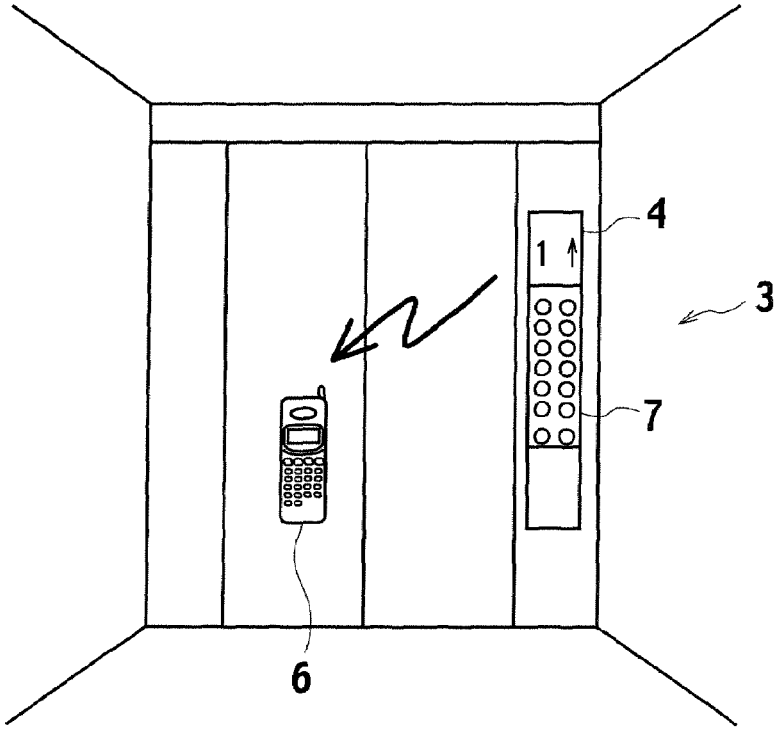
FIG. 2 is a perspective view showing an example of a camera-attached cellular phone that receives modulated LED light emitted from a display device shown in FIG. 1 and displays special guide information.

An elevator system 1*a* shown in this drawing includes: an elevator control device 2 that controls entire operations of an elevator; a display device 4 placed in a cage 3 and the like as shown in FIG. 2; and a transmission line 5 that is composed of shielded metal twisted cable or coaxial cable, an optical cable or the like, and transfers information therethrough between the elevator control device 2 and the display device 4.

Then, based on a signal of an operation state, which is outputted from the elevator control device 2, pulse-modulated visible light is emitted from the display device 4, and usual guide information (first information), for example, position information of the cage 3, an operation direction of the cage 3, and a registration state of calls of platforms, and the like are displayed on the display device 4. Moreover, as shown in FIG. 2, a camera-attached cellular phone 6 carried by each of passengers who use the elevator is allowed to display thereon predesignated information, for example, a registration state of a call of a wheelchair platform, a full-loaded state, a controlled operation state, a halt state, an under-inspection state, a cage arrival forecast, and the like.

Figure 3:
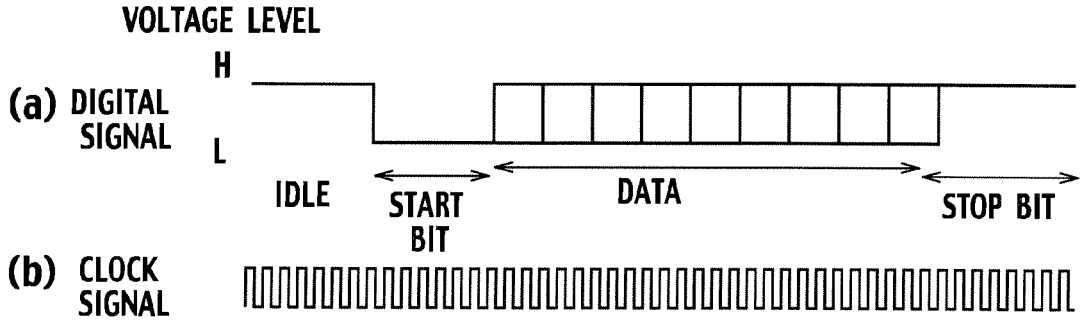
FIG. 3 is a waveform diagram showing an example of data created by an elevator control device shown in FIG. 1.

The elevator control device 2 includes: a service control unit 8; a data creation unit 9; and a data transmitting unit 10. In response to call information from an in-cage registration device 7 shown in FIG. 2, call information from call registration devices on the respective platforms, a preset operation pattern, and the like, the service control unit 8 controls a winding machine, a door control device and the like, thereby elevating/lowering and stopping the cage 3, and moving the passengers. Based on a control signal outputted from the service control unit 8, the data creation unit 9 creates data (operation state data) indicating the position information of the cage 3, the operation direction of the cage 3, the registration state of the calls of the platforms, the registration state of the call of the wheelchair platform, the full-loaded state, the controlled operation state, the halt state, the under-inspection state, the cage arrival forecast, and the like. The data transmitting unit 10 captures the data created by the data creation unit 9, creates a digital signal, in which a start bit is added to a head portion of the data, and a stop bit is added to a tail end portion of the data, in synchronization with a clock signal as shown in FIGS. 3A and 3B, and at the same time, transfers the digital signal to the display device 4 in a start-stop synchronization mode.

Then, in response to the call information from the in-cage registration device 7, the call information from the call registration devices on the respective platforms, the preset operation pattern, and the like, the elevator control device 2 creates data indicating the operation state such as the position information of the cage 3, the operation direction of the cage 3, the registration state of the calls of the platforms, the registration state of the call of the wheelchair platform, the full-loaded state, the controlled operation state, the halt state, the under-inspection state, the cage arrival forecast, and the like, supplies the created data to the display device 4, and at the same time, controls the winding machine, the door control device and the like, thereby elevating/lowering and stopping the cage 3, and moving the passengers.

The display device 4 includes: a data receiving unit 11; a pulse modulation unit 12; an LED drive unit 13; and an LED 14.

Through the transmission line 5, the data receiving unit 11 receives the data outputted from the elevator control device 2.

Figure 4:
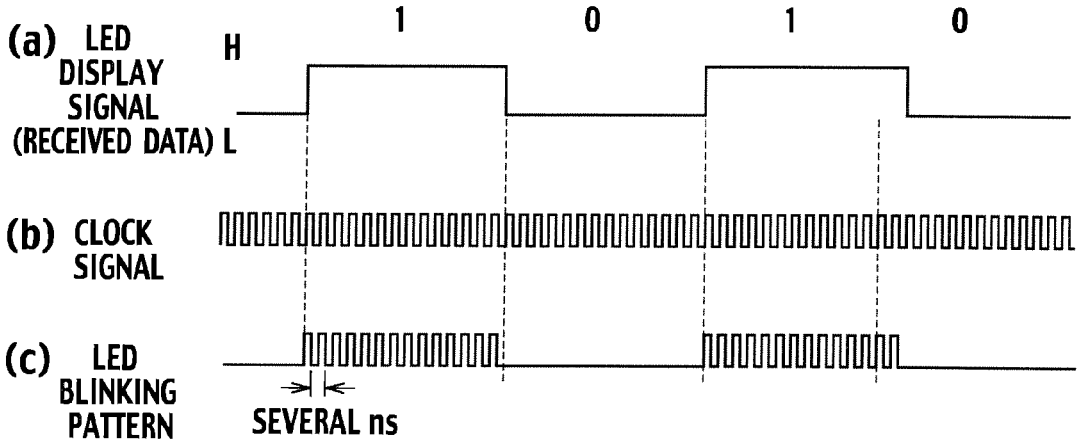
FIG. 4 is a waveform diagram showing an example of an LED blinking pattern created by the display device shown in FIG. 1.

The pulse modulation unit 12 decodes the data received by the data receiving unit 11, and creates the usual guide information (first information) and special guide information (second information). Moreover, based on the usual guide information, for example, the position information of the cage 3, the operation direction of the cage 3, the registration state of the calls of the platforms, and the like, the pulse modulation unit 12 creates an LED display signal (received data) as shown in FIG. 4A. Furthermore, based on the special guide information, for example, the registration state of the call of the wheelchair platform, the full-loaded state, the controlled operation state, the halt state, the under-inspection state, the cage arrival forecast, and the like, the pulse modulation unit 12 creates an LED blinking pattern obtained by taking a logical product of the LED display signal and the clock signal as shown in FIGS. 4A, 4B and 4C.

The LED drive unit 13 creates an LED drive voltage based on the LED blinking pattern outputted from the pulse modulation unit 12.

The LED 14 is placed on the registration device 7 in the cage. When the LED drive voltage is outputted to the LED 14 from the LED drive unit 13, the LED 14 emits modulated LED light, displays the usual guide information (first information) such as the position information of the cage 3, the operation direction of the cage 3, and the registration state of the calls of the platforms, and at the same time, displays the special guide information (second information) such as the registration state of the call of the wheelchair platform, the full-loaded state, the controlled operation state, the halt state, the under-inspection state, and the cage arrival forecast.

Note that the usual guide information and the special guide information can be appropriately selected depending on a type and using purpose of the elevator. For example, in the case of an elevator for the wheelchair, it is preferable that the "registration state of the call of the wheelchair platform" be set as the usual guide information. Moreover, in the case of an emergency elevator, it is preferable that the "controlled operation state" be set as the usual guide information.

Then, in this display device 4, the data outputted from the elevator control device 2 is received through the transmission line 5, followed by decoding, and in addition, based on the usual guide information and the special guide information, which are obtained by such a decoding operation, the LED 14 is allowed to be modulated and to emit light, whereby the usual guide information such as the position information of the cage 3, the operation direction of the cage 3, and the registration state of the calls of the platforms is displayed. Moreover, at the same time, information including the special guide information such as the registration state of the call of the wheelchair platform, the full-loaded state, the controlled operation state, the halt state, the under-inspection state, and the cage arrival forecast is transmitted by the display device 4.

In such a way, the persons in the cage 3 are notified of the usual guide information such as the position information of the cage 3, the operation direction of the cage 3, and the registration state of the calls of the platforms. Moreover, a camera portion of the cellular phone 6 carried by each of the persons is allowed to receive the modulated LED light, whereby the registration state of the call of the wheelchair platform, the full-loaded state, the controlled operation state, the halt state, the under-inspection state, the cage arrival forecast and the like are offered to a display of the cellular phone 6.

As descried above, in the first embodiment, the LED 14 placed in the cage 3 and the like is allowed to blink at a high speed based on the data outputted from the elevator control device 2, and the persons who see the LED 14 are notified of the usual guide information. Moreover, the camera portion of the cellular phone 6 carried by each of the persons in the cage 3 or on the platforms and the like is allowed to receive the modulated LED light, whereby the registration state of the call of the wheelchair platform, the full-loaded state, the controlled operation state, the halt state, the under-inspection state, the cage arrival forecast and the like are adapted to be offered to the display of the cellular phone 6. Accordingly, the passengers can be notified of the special guide information such as the registration state of the call of the wheelchair platform, the full-loaded state, the controlled operation state, the halt state, the under-inspection state, and the cage arrival forecast without placing a dedicated communication instrument such as a wireless LAN instrument, or the like, or without adversely affecting human bodies. In such a way, convenience for the passengers can be enhanced to a great extent.

SECOND EMBODIMENT

Figure 5:
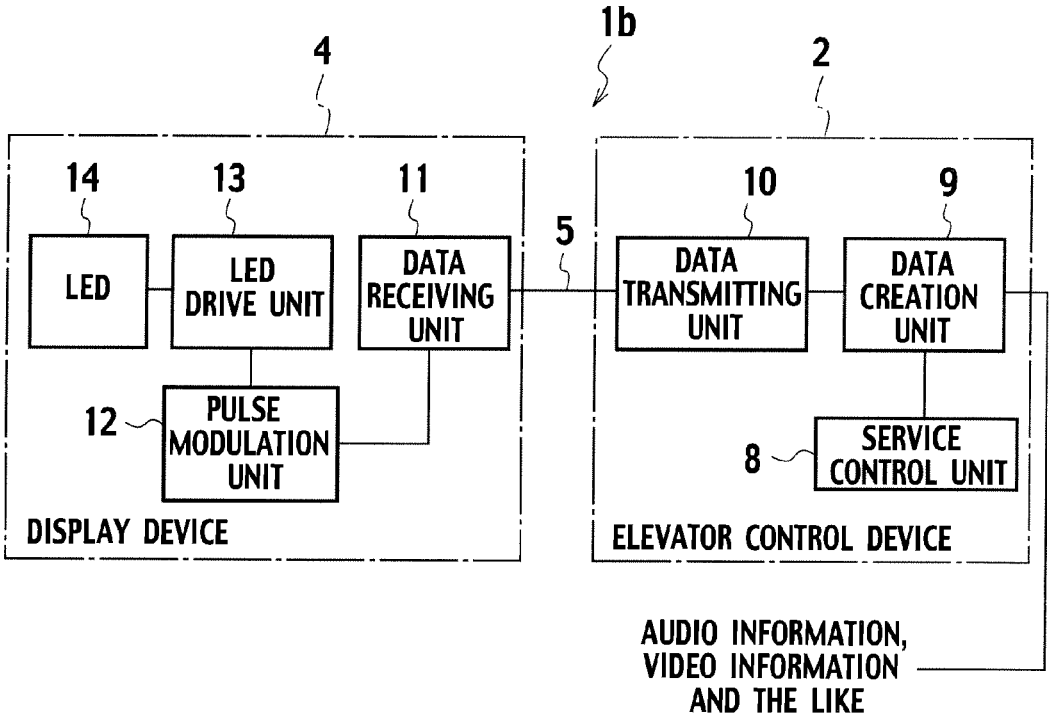
FIG. 5 is a block diagram showing a second embodiment of the elevator system according to the present invention.

FIG. 5 is a block diagram showing a second embodiment of the elevator system according to the present invention.

A different point of an elevator system 1*b* shown in this drawing from the elevator system 1*a* shown in FIG. 1 is that audio information, video information, textual information, control command information for use in other electronic instruments, and the like are captured into the elevator control device 2, and modulated LED light corresponding to these audio information, video information, textual information, command information for use in the other electronic instruments, and the like are created from the LED 14 of the display device 4.

In such a way, in the second embodiment, music, guidance of a building and the like can be vocally outputted from the cellular phone 6 carried by each of such users in the cage or on the platforms, or the video information and the textual information can be displayed on the display of the cellular phone. Alternatively, the cellular phone 6 can be allowed to perform a specific operation by using a control command for use in the other electronic instruments. For example, the cellular phone 6 can be allowed to make a phone call to a specific telephone number.

THIRD EMBODIMENT

Figure 6:
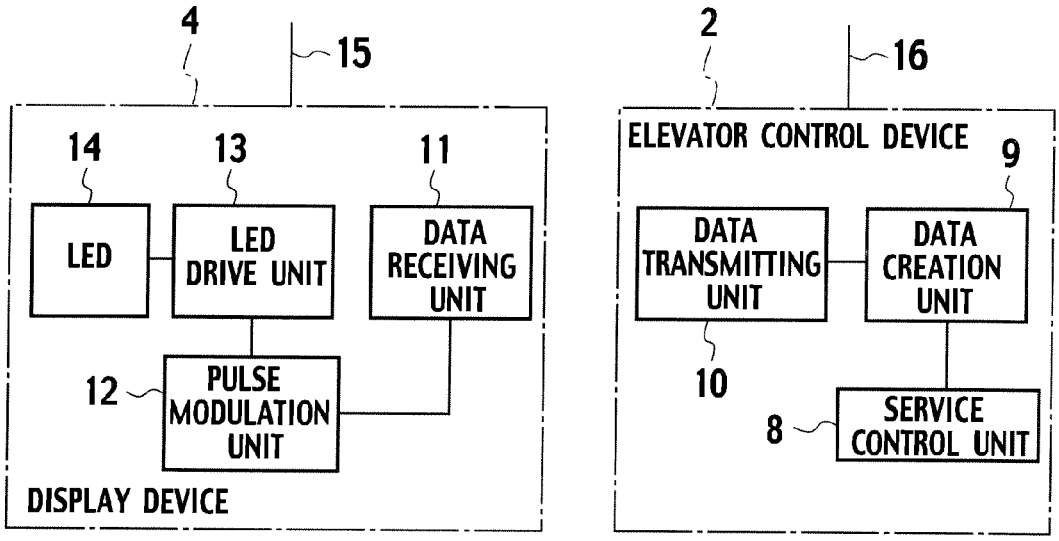
FIG. 6 is a block diagram showing a third embodiment of the elevator system according to the present invention.

FIG. 6 is a block diagram showing a third embodiment of the elevator system according to the present invention.

A different point of an elevator system 1*c* shown in this drawing from the elevator system 1*a* shown in FIG. 1 is that the transmission line 5 composed of shielded metal twisted cable or coaxial cable, an optical cable or the like is removed from between the elevator control device 2 and the display device 4. Then, a communication between the elevator control device 2 and the display device 4 is adapted to be performed by power line communication (PLC) using power lines 15 and 16 which supply electric power thereto, respectively.

In such a way, in the third embodiment, the digital signal created by the elevator control device 2 is supplied to the display device 4 by using the power line communication using the power lines 15 and 16 which supply the electric power to the elevator control device 2 and the display device 4, respectively. Accordingly, such dedicated transmission lines become unnecessary among the elevator control device 2, the cage 3 and the platforms. Moreover, the special guide information such as the registration state of the call of the wheelchair platform, the full-loaded state, the controlled operation state, the halt state, the under-inspection state, and the cage arrival forecast is offered to the passengers without adversely affecting the human bodies. In such a way, the convenience for the passengers can be enhanced to a great extent.

FOURTH EMBODIMENT

Figure 7:
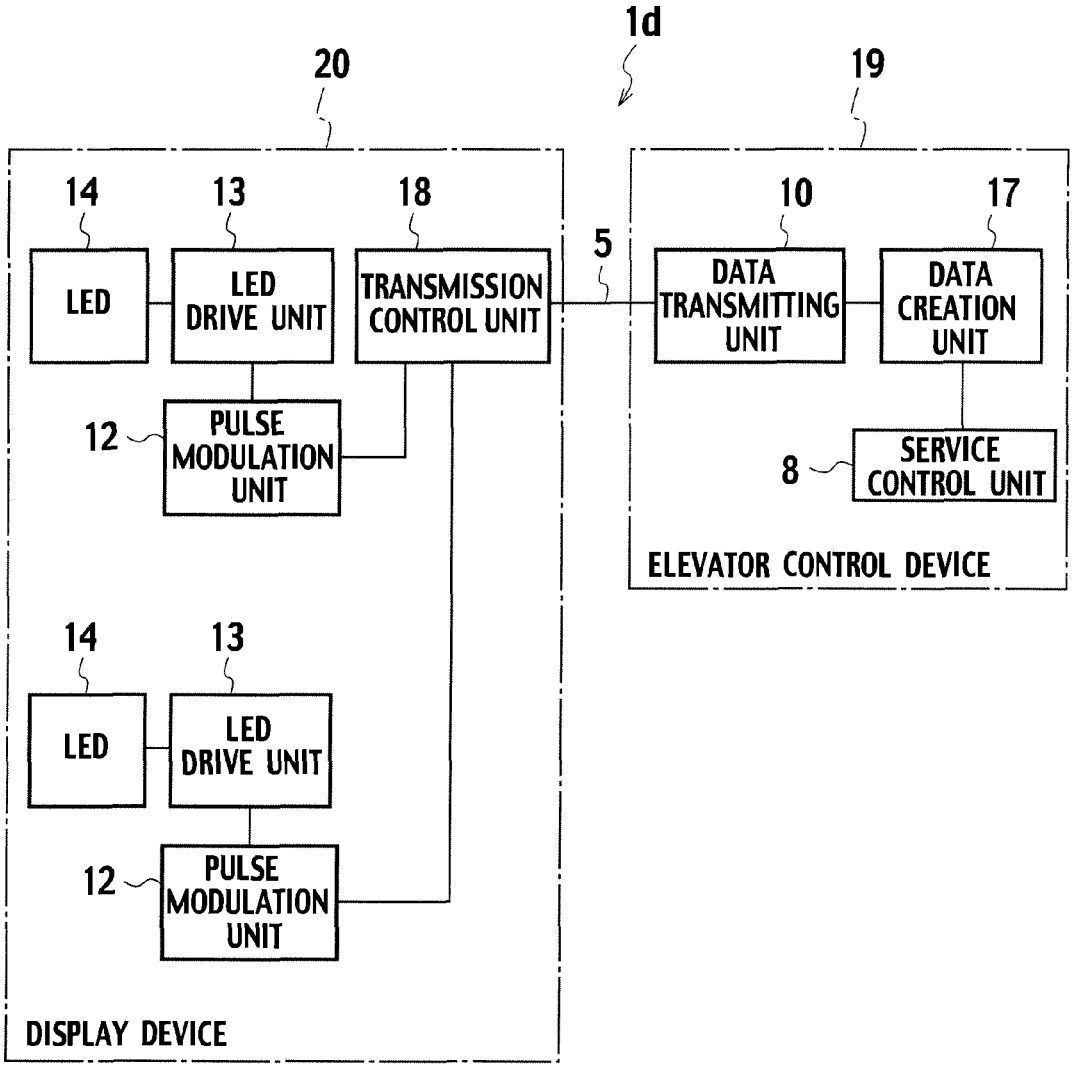
FIG. 7 is a block diagram showing a fourth embodiment of the elevator system according to the present invention.

FIG. 7 is a block diagram showing a fourth embodiment of the elevator system according to the present invention.

A different point of an elevator system 1*d* shown in this drawing from the elevator system 1*a* shown in FIG. 1 is in that a data creation unit 17 that creates plural data different in frequency is provided instead of the data creation unit (data creation unit that creates data by using one frequency) 9, and that a transmission control unit 18 that separates the digital signal into each of frequency components and restores the plural data is provided. In this example, a digital signal in which the plural data is frequency-multiplexed is outputted from an elevator control device 19, and the data is separated into each of the frequency components by the transmission control unit 18 of a display device 20, and is supplied to each of the pulse modulation units 12. In such a way, each of the LEDs 14 is allowed to blink at a high speed in a blinking pattern and a color, which are different from those of the others.

In such a way, in the fourth embodiment, such different kinds of the data are adapted to be transmitted from the elevator control device 19 to the display device 20 by one transmission line 5, and the different kinds of data are adapted to be outputted from the respective LEDs 14 in the colors different from each other. Accordingly, the passengers can be simultaneously notified of plural kinds of information without placing the dedicated communication instrument such as the wireless LAN instrument, or the like, or without adversely affecting the human bodies. In such a way, a voice announcement for able-bodied people and a voice announcement for visually handicapped people can be transmitted separately from each other.

Moreover, if an optical filter that transmits a specific color therethrough is mounted on a lens portion of the camera-attached cellular phone, and so on, then the voice announcement for the able-bodied people and the voice announcement for the visually handicapped people can be transmitted separately from each other.

OTHER EMBODIMENTS

In the respective embodiments described above, the example has been shown, where the camera-attached cellular phone 6 is used as a receiving device of visible light communication; however a similar effect can be expected if an instrument provided with a light receiving function as described above is used.

For example, a receiving device provided with the light receiving function is placed on a floor surface of each of the platforms, and the visible light LED communication is performed therefor from an arrival lamp (lantern) or the like of the elevator, which is placed on the platform. In this case, as an example of the function, a configuration can also be adopted, in which, at the same time when the cage arrives at the platform, the lantern is turned on, and such an announcement saying "Elevator is approaching" is allowed to come from a microphone built in the floor surface.

Moreover, if the light receiving function and a speaker are mounted on a white stick carried by a visually handicapped person, then application examples of the present invention are increased. For example, with regard to a call button on the platform, the LED built therein is turned on when a call is registered thereto. If the visible light communication function is mounted on the LED concerned, then such an announcement saying "Elevator button is already pressed" can be allowed to come from the white stick at the time when the visually handicapped person who carries the white stick approaches the platform.

Furthermore, in the respective embodiments described above, the data is adapted to be transmitted from the elevator control device 2 to the instruments provided with the LEDs, such as the display devices 4 and 19 and the illumination devices; however, a data transmitting source may be an instrument other than the elevator control device 2. For example, a configuration may be adopted, in which the data transmitting source is a DVD or a digital TV broadcaster, the data is transmitted by wire from such an instrument to the inside of the cage 3 and to the display devices 4 and 19 and the illumination devices on the platforms, the visible light communication is performed by the LEDs mounted on the display devices 4 and 19 and the illumination devices, and the data is received by the camera-attached cellular phone 6 and the like.

Moreover, the present invention is applicable not only to the elevator but also to an escalator as a lifting machine in the same way.

The invention claimed is:

1. An elevator system, comprising:

a data receiving unit that receives service state data transmitted from a control device of an elevator;

a pulse modulation unit that separates the service state data received by the data receiving unit into first information data and second information data, pulse-modulates the first information data by using the second information data, and creates an LED blinking pattern; and an LED drive unit that drives a visible light LED placed in a cage of the elevator or on a platform of the elevator in response to the LED blinking pattern created by the pulse modulation unit.

2. The elevator system according to claim 1, wherein the second information data contained in the service state data received by the data receiving unit is any of audio information, video information, textual information, which are digital-converted, or a command signal for controlling other electronic instruments.

3. The elevator system according to claim 1, wherein the service state data created by the control device of the elevator is transmitted to the data receiving unit by using power line communication.

4. The elevator system according to claim 1, wherein the control device of the elevator creates service state data in which plural data is frequency-multiplexed, and the pulse modulation unit separates the data into the first information data and the second information data for each of frequency components obtained by separating the service state data for each frequency, creates a plurality of the LED blinking patterns by pulse-modulating the first information data by using the second information data, and allows the visible light LED to emit light.

5. The elevator system according to claim 1, wherein the first information data is usual guide information including at least one of a position information of the cage, an operation direction of the cage, and a registration state of calls of platforms, and the second information data is special information including at least one of a registration state of a call of the wheelchair platform, a full-loaded state, a controlled operation state, a halt state, an under-inspection state, and a cage arrival forecast.

6. The elevator system according to claim 1, wherein the first information data is special information including at least one of a registration state of a call of the wheelchair platform, a full-loaded state, a controlled operation state, a halt state, an under-inspection state, and a cage arrival forecast, and the second information data is usual guide information including at least one of a position information of the cage, an operation direction of the cage, and a registration state of calls of platforms.

7. The elevator system according to claim 1, wherein visible light including the LED blinking pattern created by the pulse modulation unit can be received and utilized in a portable device.

8. The elevator system according to claim 7, wherein the visible light provides a visible display of the first information to a passenger on the elevator, and wherein the LED blinking pattern is decodable by the portable device so as to provide a visible display of the second information on a display of the portable device.

* * * * *